US011607798B2

(12) United States Patent
Liou

(10) Patent No.: US 11,607,798 B2
(45) Date of Patent: Mar. 21, 2023

(54) HAMMER TOOL

(71) Applicant: Tang Chou Industrial Co., Ltd., Nantou County (TW)

(72) Inventor: Mou-Tang Liou, Taichung (TW)

(73) Assignee: Tang Chou Industrial Co., Ltd., Nantou County (TW)

( * ) Notice: Subject to any disclaimer, the term of this patent is extended or adjusted under 35 U.S.C. 154(b) by 302 days.

(21) Appl. No.: 16/983,123

(22) Filed: Aug. 3, 2020

(65) Prior Publication Data

US 2022/0032444 A1 Feb. 3, 2022

(51) Int. Cl.
*B25G 3/34* (2006.01)
*B25D 1/04* (2006.01)

(52) U.S. Cl.
CPC ..... *B25G 3/34* (2013.01); *B25D 1/04* (2013.01)

(58) Field of Classification Search
CPC ..... B25G 3/34; B25D 1/04
See application file for complete search history.

(56) References Cited

U.S. PATENT DOCUMENTS

| | | | | |
|---|---|---|---|---|
| 4,287,640 | A * | 9/1981 | Keathley | B25G 3/34 81/22 |
| 5,123,303 | A * | 6/1992 | Lee | B25D 1/04 254/26 R |
| 5,299,475 | A * | 4/1994 | Stroop | B25G 3/26 81/20 |
| 10,683,648 | B2 * | 6/2020 | Beck | B25G 3/14 |

FOREIGN PATENT DOCUMENTS

| | | |
|---|---|---|
| TW | 294100 | 12/1996 |

* cited by examiner

*Primary Examiner* — Hadi Shakeri
(74) *Attorney, Agent, or Firm* — Alan D. Kamrath; Karin L. Williams; Mayer & Williams PC

(57) ABSTRACT

A hammer tool includes a hammer head and a handle. The hammer head includes an insertion hole and first and second side holes aligned with each other and located on two opposite sides of and intercommunicating with the insertion hole. The handle includes an insertion portion on an end thereof. The insertion portion is inserted into the insertion hole. A first coupling flange is integrally formed with the insertion portion and is inserted into the first side hole. The handle includes a hollow portion extending in a longitudinal direction thereof. The handle further includes a third side hole extending in a radial direction thereof. An end of the third side hole intercommunicates with the hollow portion. Another end of the third side hole extends to an outer periphery of the insertion portion. The third side hole is aligned with the second side hole.

5 Claims, 6 Drawing Sheets

HAMMER TOOL

BACKGROUND OF THE INVENTION

The present invention relates to a tool and, more particularly, to a hammer tool.

Taiwan Patent No. 294100 discloses a hammer including a hammer head, a handle, and a hammer head fixing structure. An end of the handle is fixed in the hammer head and includes an end face having an axially extending receiving groove. The hammer head fixing structure includes a nail and a pin. The nail includes an axially extending through-hole having an inner wall with an inclined face. The through-hole further includes an incoming hole section on a side of the inclined face and an outwardly expanding hole section on another side of the inclined face. The outwardly expanding hole section has an inner diameter smaller than an outer diameter of the pin. The pin axially extends into the incoming hole section and then extends along the inclined face into the outwardly expanding hole section. The nail includes at least one tooth on an outer periphery thereof. The at least one tooth has a peak extending towards the incoming hole section. The nail further includes a plurality of axially extending slits in an outer wall of the outwardly expanding hole section. Thus, the pin can be pressed inwards to tightly couple the hammer head with the handle.

However, the hammer head fixing structure is only suitable for a wooden handle which tends to wear, deform, and deteriorate. Thus, the fixing effect of the hammer head fixing structure will be reduced after long-term use, and the hammer will disengage from the handle.

Thus, a need exists for a hammer tool that mitigates and/or obviates the above disadvantages.

BRIEF SUMMARY OF THE INVENTION

A hammer tool according to the present invention includes a hammer head and a handle. The hammer head includes an insertion hole, a first side hole extending in a radial direction of the insertion hole, and a second side hole extending in a radial direction of the insertion hole. The first side hole and the second side hole align with each other and are located on two opposite sides of the insertion hole. The first side hole intercommunicates with the insertion hole. The second side hole includes a first end intercommunicating with the insertion hole and a second end extending to an outer periphery of the hammer head. The handle includes an insertion portion on an end thereof. The insertion portion is inserted into the insertion hole. The insertion portion includes a first coupling flange integrally formed therewith. The first coupling flange is inserted into the first side hole. The handle includes a hollow portion extending in a longitudinal direction of the handle. The handle further includes a third side hole extending in a radial direction of the handle. An end of the third side hole intercommunicates with the hollow portion. Another end of the third side hole extends to an outer periphery of the insertion portion. The third side hole is aligned with the second side hole.

In an example, the first coupling flange is formed by deforming the handle through squeezing.

In an example, the hollow portion includes an inner periphery having a first squeezing groove aligned with the first coupling flange.

In an example, the first coupling flange is formed by punching or squeezing the inner periphery of the hollow portion to form the first squeezing groove in the inner periphery of the hollow portion and to form the first coupling flange on the outer periphery of the insertion portion.

In an example, the hammer head includes a first end and a second end opposite to the second end in a longitudinal direction of the hammer head. The insertion hole extends from the first end through the second end of the hammer head. The insertion portion of the handle is inserted into the insertion hole via the first end of the hammer head. The insertion hole has a first width in a diametric direction thereof. The insertion portion includes a disengagement prevention flange in a radial direction of the handle. The disengagement prevention flange is adjacent to an end face of the insertion portion. The disengagement prevention flange has a second width in a diametric direction of the handle. The second width is larger than the first width. The disengagement prevention flange abuts against the second end of the hammer head.

In an example, the disengagement prevention flange is formed by squeezing the inner periphery of the hollow portion to cause radially outward expanding deformation.

In an example, the outer periphery of the hammer head includes a first side and a second side spaced from the first side in the diametric direction of the insertion hole. An end of the first side hole intercommunicates with the insertion hole. Another end of the first side hole extends to the first side. The second end of the second side hole extends to the second side of the hammer head. The hammer head includes fourth and fifth side holes in a diametric direction thereof. The fourth and fifth side holes are aligned with each other and are located on two opposite sides of the insertion hole. An end of the fourth side hole intercommunicates with the insertion hole. Another end of the fourth side hole extends to the first side of the hammer head. An end of the fifth side hole intercommunicates with the insertion hole. Another end of the fifth side hole extends to the second side of the hammer head. The insertion portion further includes a second coupling flange integrally formed therewith. The second coupling flange is inserted into the fifth side hole. The handle further includes a sixth side hole in a radial direction thereof. An end of the sixth side hole intercommunicates with the hollow portion. Another end of the sixth side hole extends to the outer periphery of the insertion portion. The sixth side hole is aligned with the fourth side hole. The inner periphery of the hollow portion includes a second squeezing groove aligned with the second coupling flange. The second coupling flange is formed by punching or squeezing the inner periphery of the hollow portion to form the second squeezing groove in the inner periphery of the hollow portion and to simultaneously form the second coupling flange on the outer periphery of the insertion portion.

In an example, the first coupling flange has a first spacing to an end face of the insertion portion in the longitudinal direction of the insertion portion. The second coupling flange has a second spacing to the end face of the insertion portion in the longitudinal direction of the insertion portion. The second spacing is smaller than the first spacing.

In an example, the handle further includes a limiting flange protruding radially outward from the outer periphery of the handle. The limiting flange is contiguous to the insertion portion and has a third width in a diametric direction. The third width is larger than the first diameter. The limiting flange extends around the outer periphery of the handle.

In an example, the inner periphery of the hollow portion includes an annular groove extending around the inner periphery of the hollow portion. The annular groove is aligned with the limiting protrusion.

The present invention will become clearer in light of the following detailed description of illustrative embodiments of this invention described in connection with the drawings.

DETAILED DESCRIPTION OF THE INVENTION

Figure 1:
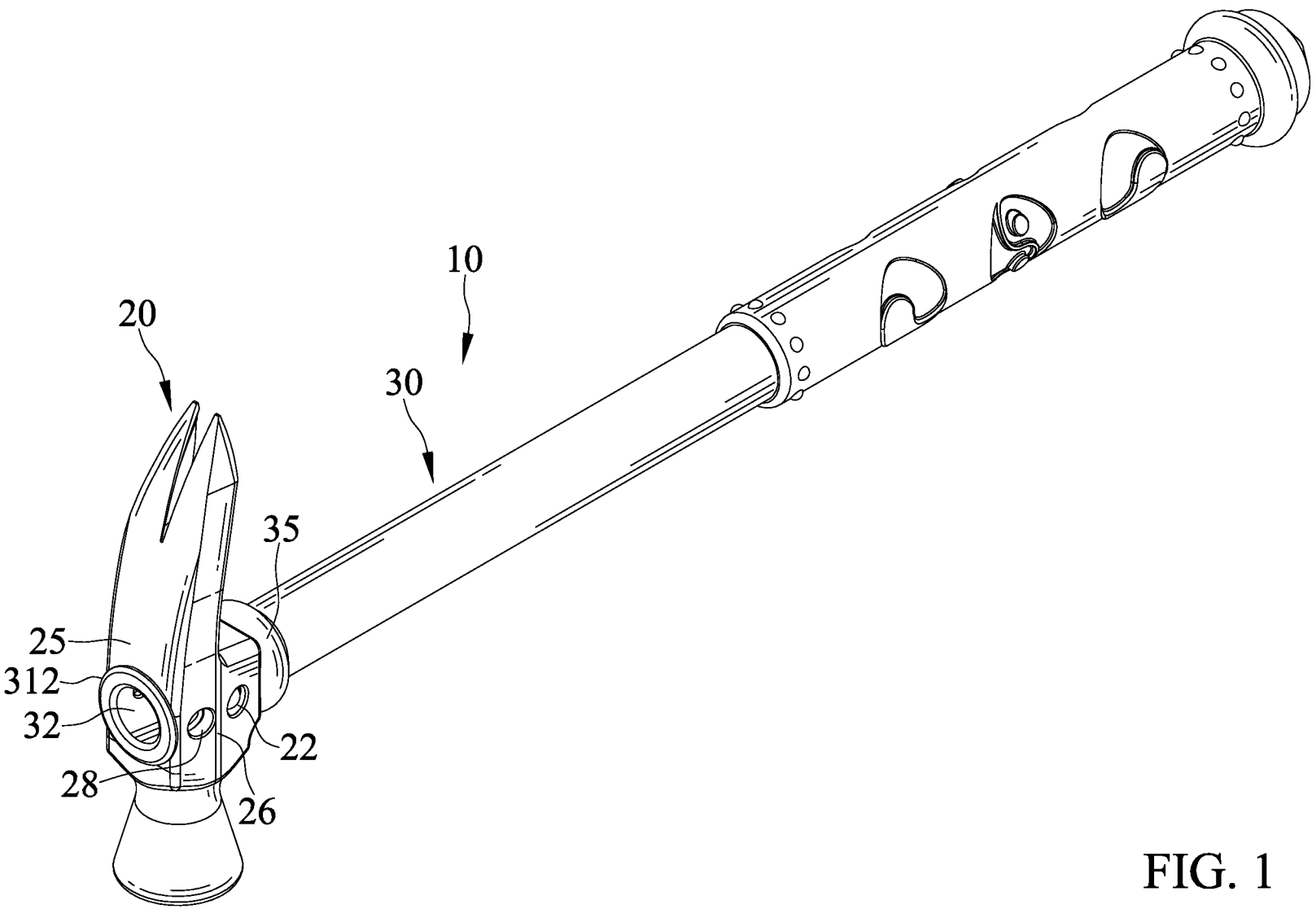
FIG. 1 is a perspective view of a hammer tool of an embodiment according to the present invention.
Figure 2:
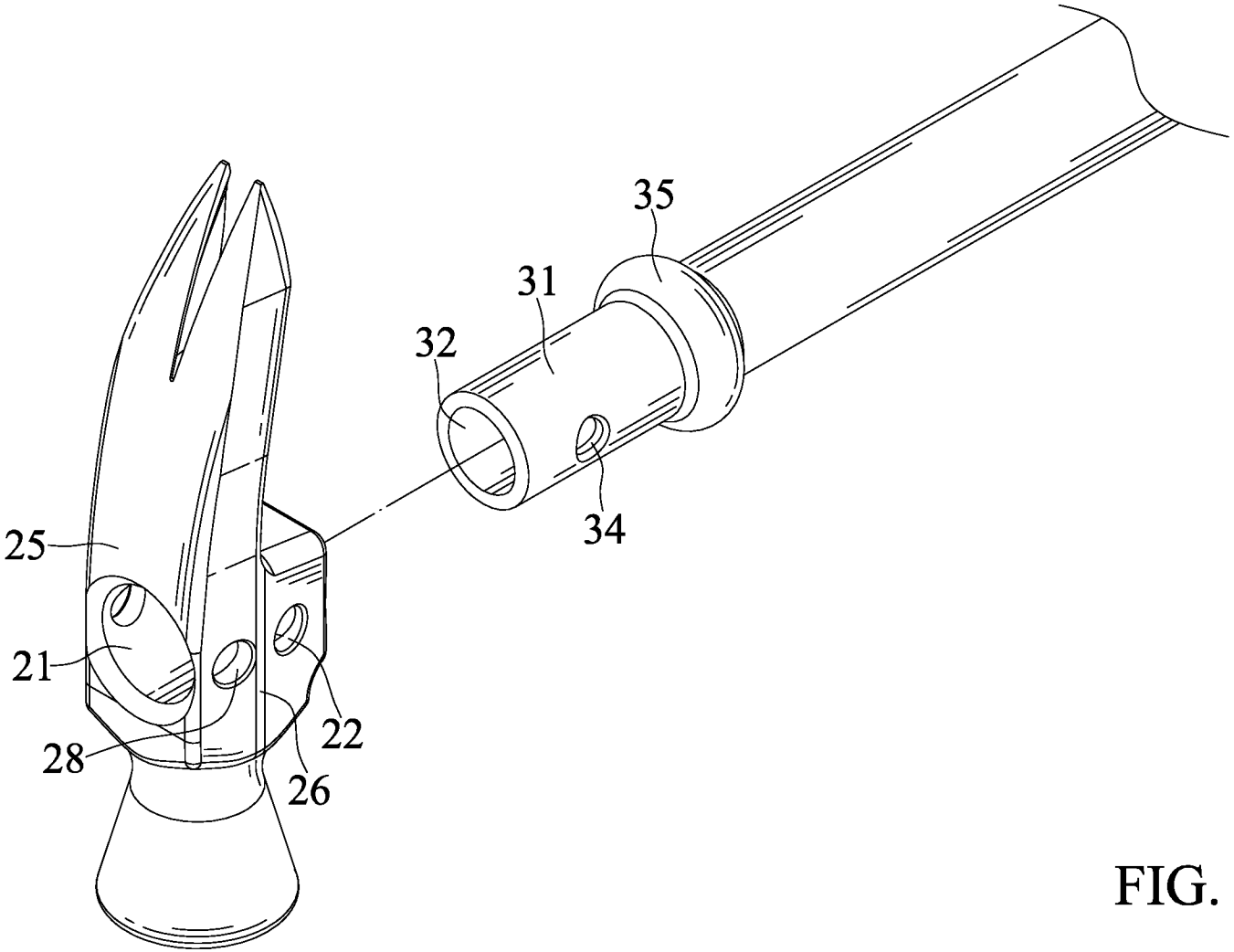
FIG. 2 is a partial, exploded, perspective view of the hammer tool of FIG. 1.
Figure 3:
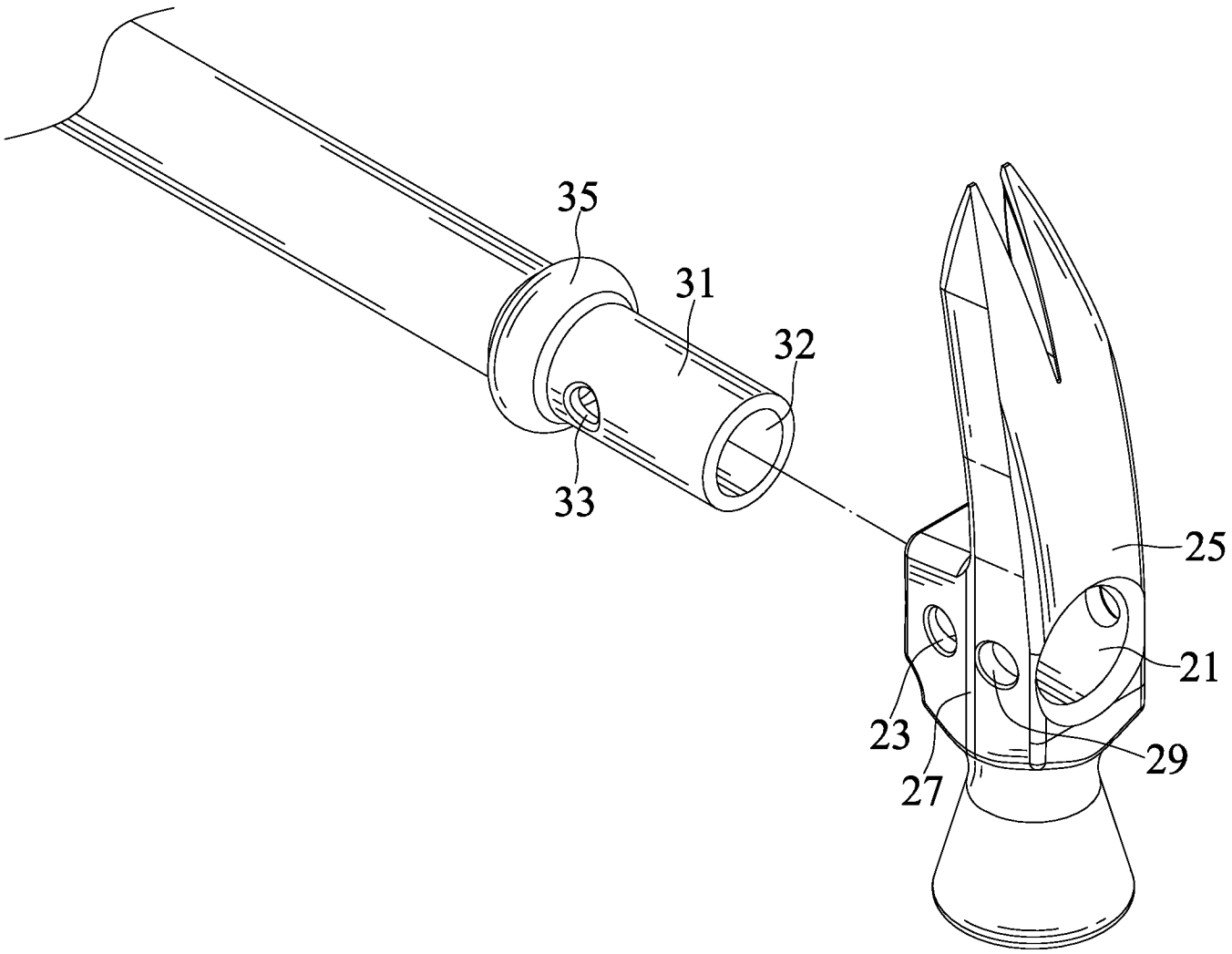
FIG. 3 is another partial, exploded, perspective view of the hammer tool of FIG. 1.
Figure 4:
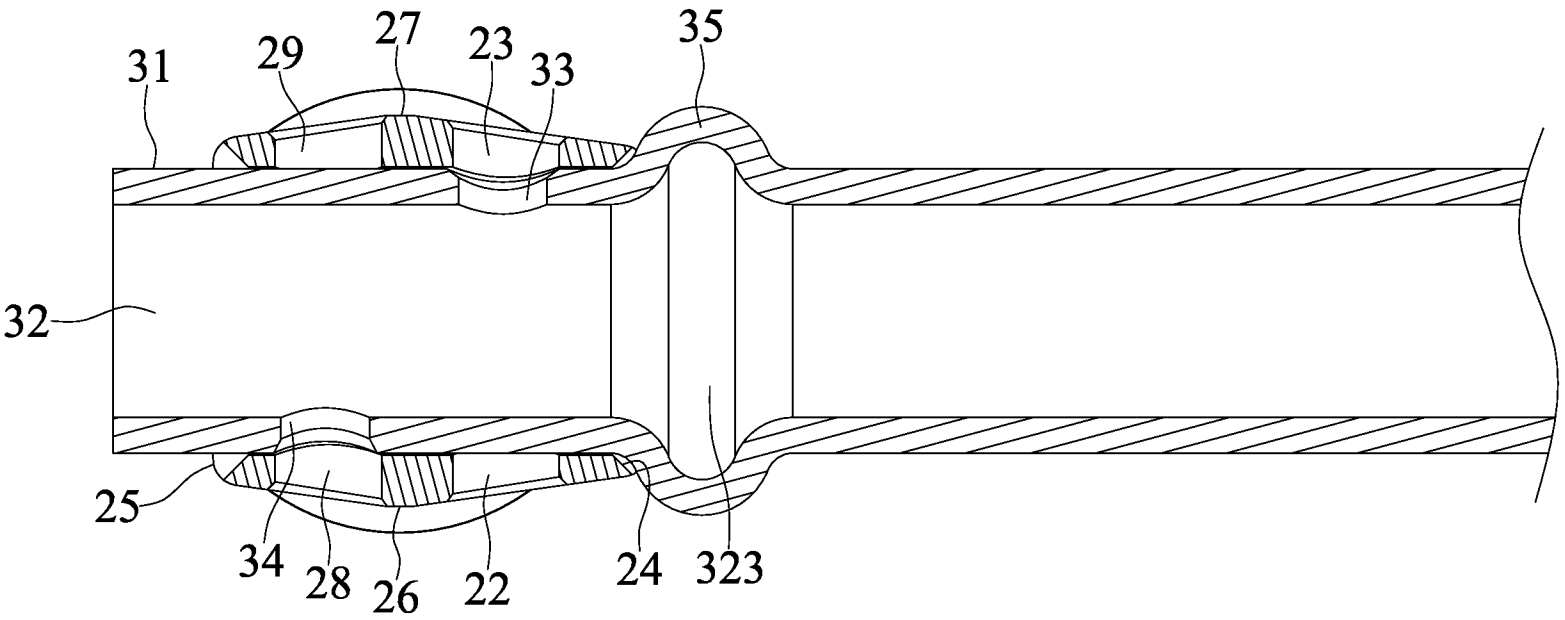
FIG. 4 is a partial, cross sectional view of the hammer tool before an insertion portion deforms.
Figure 5:
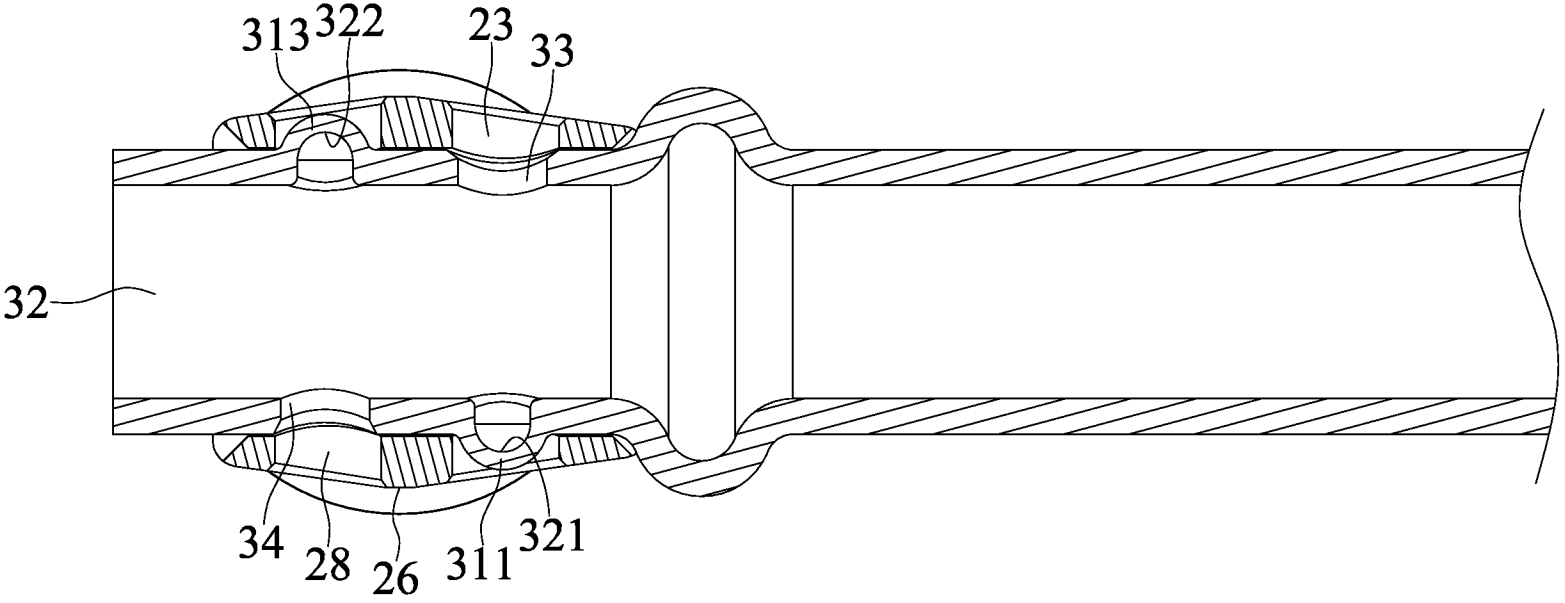
FIG. 5 is a partial, cross sectional view of the hammer tool with first and second coupling flanges resulting from deformation of the insertion portion.
Figure 6:
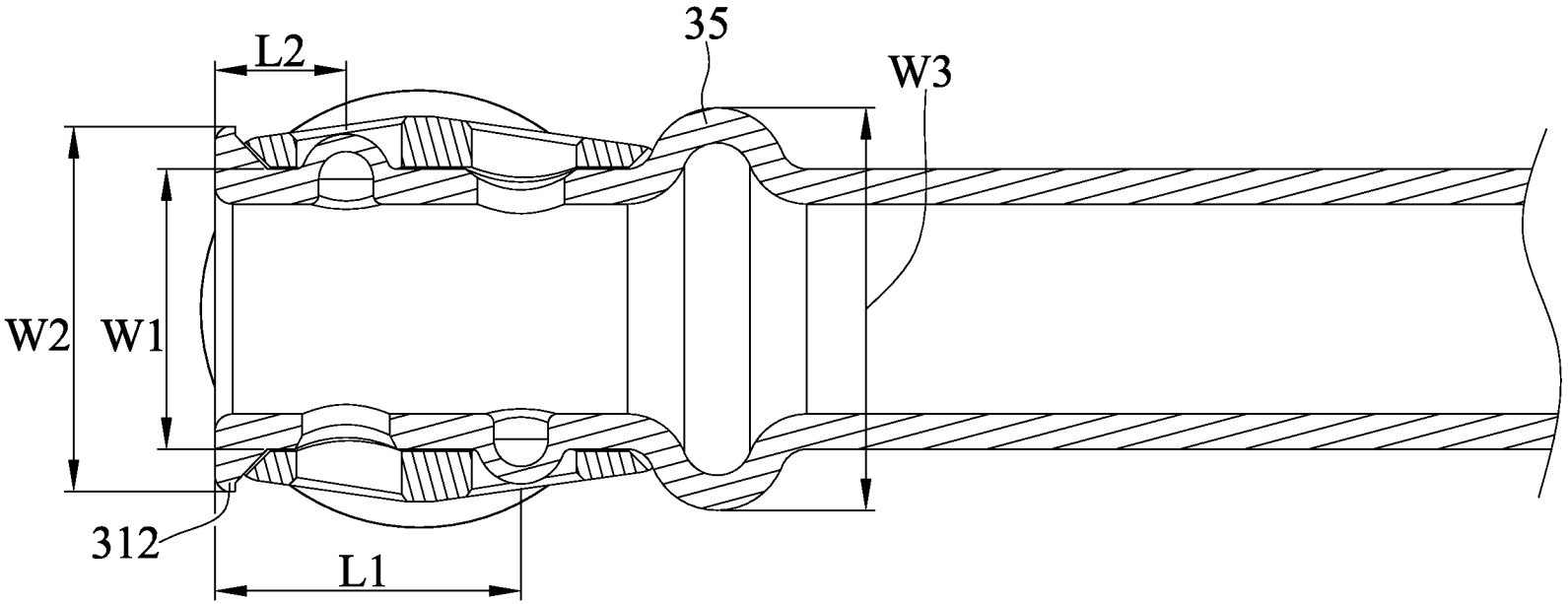
FIG. 6 is a cross sectional view illustrating a disengagement prevention flange resulting from deformation of the insertion portion of the hammer tool.

With reference to FIGS. 1-6, the hammer tool 10 according to the present invention includes a hammer head 20 and a handle 30. The hammer head 20 includes an insertion hole 21, a first side hole 22 extending in a radial direction of the insertion hole 21, and a second side hole 23 extending in a radial direction of the insertion hole 21. The first side hole 22 and the second side hole 23 align with each other and are located on two opposite sides of the insertion hole 21. The first side hole 22 intercommunicates with the insertion hole 21. The second side hole 23 includes a first end intercommunicating with the insertion hole 21 and a second end extending to an outer periphery of the hammer head 20.

The handle 30 includes an insertion portion 31 on an end thereof. The insertion portion 31 is inserted into the insertion hole 21. The insertion portion 31 includes a first coupling flange 311 integrally formed therewith. The first coupling flange 311 is inserted into the first side hole 22. The handle 30 includes a hollow portion 32 extending in a longitudinal direction of the handle 30. The handle 30 further includes a third side hole 33 extending in a radial direction of the handle 30. An end of the third side hole 33 intercommunicates with the hollow portion 32. Another end of the third side hole 33 extends to an outer periphery of the insertion portion 31. The third side hole 33 is aligned with the second side hole 23.

The first coupling flange 311 is formed by deforming the handle 30 through squeezing. The hollow portion 32 includes an inner periphery having a first squeezing groove 321 aligned with the first coupling flange 311. In this embodiment, the first coupling flange 311 is formed by punching or squeezing the inner periphery of the hollow portion 32 to form the first squeezing groove 321 in the inner periphery of the hollow portion 32 and to simultaneously form the first coupling flange 311 on the outer periphery of the insertion portion 31.

The hammer head 20 includes a first end 24 and a second end 25 opposite to the second end 25 in a longitudinal direction of the hammer head 20. The insertion hole 21 extends from the first end 24 through the second end 25 of the hammer head 20. The insertion portion 31 of the handle 30 is inserted into the insertion hole 21 via the first end 24 of the hammer head 20. The insertion hole 21 has a first width W1 in a diametric direction thereof. The insertion portion 31 includes a disengagement prevention flange 312 in a radial direction of the handle 30. The disengagement prevention flange 312 is adjacent to an end face of the insertion portion 31. The disengagement prevention flange 312 has a second width W2 in a diametric direction of the handle 30. The second width W2 is larger than the first width W1. The disengagement prevention flange 312 abuts against the second end 25 of the hammer head 20. The disengagement prevention flange 312 is formed by squeezing the inner periphery of the hollow portion 32 to cause radially outward expanding deformation.

The outer periphery of the hammer head 20 includes a first side 26 and a second side 27 spaced from the first side 26 in the diametric direction of the insertion hole 21. An end of the first side hole 22 intercommunicates with the insertion hole 21. Another end of the first side hole 22 extends to the first side 26. The second end of the second side hole 23 extends to the second side 27 of the hammer head 20. The hammer head 20 includes fourth and fifth side holes 28 and 29 in a diametric direction thereof. The fourth and fifth side holes 28 and 29 are aligned with each other and are located on two opposite sides of the insertion hole 21. An end of the fourth side hole 28 intercommunicates with the insertion hole 21. Another end of the fourth side hole 28 extends to the first side 26 of the hammer head 20. An end of the fifth side hole 29 intercommunicates with the insertion hole 21. Another end of the fifth side hole 29 extends to the second side 27 of the hammer head 20. The insertion portion 31 further includes a second coupling flange 313 integrally formed therewith. The second coupling flange 313 is inserted into the fifth side hole 29. The handle 30 further includes a sixth side hole 34 in a radial direction thereof. An end of the sixth side hole 34 intercommunicates with the hollow portion 32. Another end of the sixth side hole 34 extends to the outer periphery of the insertion portion 31. The sixth side hole 34 is aligned with the fourth side hole 28. The inner periphery of the hollow portion 32 includes a second squeezing groove 322 aligned with the second coupling flange 313. In this embodiment, the second coupling flange 313 is formed by punching or squeezing the inner periphery of the hollow portion 32 to form the second squeezing groove 322 in the inner periphery of the hollow portion 32 and to simultaneously form the second coupling flange 313 on the outer periphery of the insertion portion 31.

The first coupling flange 311 has a first spacing L1 to an end face of the insertion portion 31 in the longitudinal direction of the insertion portion 31. The second coupling flange 313 has a second spacing L2 to the end face of the insertion portion 31 in the longitudinal direction of the insertion portion 31. The second spacing L2 is smaller than the first spacing L1.

The handle 30 further includes a limiting flange 35 protruding radially outward from the outer periphery of the handle 30. The limiting flange 35 is contiguous to the insertion portion 31 and has a third width W3 in a diametric direction. The third width W3 is larger than the first diameter W1. The limiting flange 35 extends around the outer periphery of the handle 30.

The inner periphery of the hollow portion 32 includes an annular groove 323 extending around the inner periphery of the hollow portion 32. The annular groove 323 is aligned with the limiting protrusion 35.

An excellent coupling strength can be obtained by the hammer tool 10 with the above structure to assure that the hammer head 20 will not disengage from the handle 30 during hammering. The hammer head 20 of this embodiment can provide a hammering function as well as a plying function. The hammer head 20 can also be in the form of an axe or any tool allowing swinging. When processing the first coupling flange 311, a processing machine extends through the second side hole 23 and the third side hole 33 and squeezes the inner periphery of the hollow portion 32 to form the first squeezing groove 321 in the inner periphery of the hollow portion 32 and to simultaneously form the first coupling flange 313 on the outer periphery of the insertion portion 31. Likewise, when processing the second coupling flange 313, the processing machine extends through the fourth side hole 28 and the sixth side hole 34 and squeezes the inner periphery of the hollow portion 32 to form the second squeezing groove 322 in the inner periphery of the hollow portion 32 and to simultaneously form the second coupling flange 313 on the outer periphery of the insertion portion 31.

Although specific embodiments have been illustrated and described, numerous modifications and variations are still possible without departing from the scope of the invention. The scope of the invention is limited by the accompanying claims.

The invention claimed is:

1. A hammer tool comprising:

a hammer head including an insertion hole, a first side hole extending in a radial direction of the insertion hole, and a second side hole extending in a radial direction of the insertion hole, wherein the first side hole and the second side hole align with each other and are located on two opposite sides of the insertion hole, wherein the first side hole intercommunicates with the insertion hole, wherein the second side hole includes a first end intercommunicating with the insertion hole and a second end extending to an outer periphery of the hammer head; and a handle including an insertion portion on an end thereof, wherein the insertion portion is inserted into the insertion hole, wherein the insertion portion includes a first coupling flange integrally formed therewith, wherein the first coupling flange is inserted into the first side hole, wherein the handle includes a hollow portion extending in a longitudinal direction of the handle, wherein the handle further includes a third side hole extending in a radial direction of the handle, wherein an end of the third side hole intercommunicates with the hollow portion, wherein another end of the third side hole extends to an outer periphery of the insertion portion, and wherein the third side hole is aligned with the second side hole, wherein the hollow portion includes an inner periphery having a first, squeezing groove aligned with the first coupling flange, and wherein the hammer head includes a first end and a second end opposite to the second end in a longitudinal direction of the hammer head, wherein the insertion hole extends from the first end through the second end of the hammer head, wherein the insertion portion of the handle is inserted into the insertion hole via the first end of the hammer head, wherein the insertion hole has a first width in a diametric direction thereof, wherein the insertion portion includes a disengagement prevention flange in a radial direction of the handle, wherein the disengagement prevention flange is adjacent to an end face of the insertion portion, wherein the disengagement prevention flange has a second width in a diametric direction of the handle, wherein the second width is larger than the first width, and wherein the disengagement prevention flange abuts against the second end of the hammer head.

2. The hammer tool as claimed in claim 1, wherein the outer periphery of the hammer head includes a first side and a second side spaced from the first side in the diametric direction of the insertion hole, wherein an end of the first side hole intercommunicates with the insertion hole, wherein another end of the first side hole extends to the first side, wherein the second end of the second side hole extends to the second side of the hammer head, wherein the hammer head includes fourth and fifth side holes in a diametric direction thereof, wherein the fourth and fifth side holes are aligned with each other and are located on two opposite sides of the insertion hole, wherein an end of the fourth side hole intercommunicates with the insertion hole, wherein another end of the fourth side hole extends to the first side of the hammer head, wherein an end of the fifth side hole intercommunicates with the insertion hole, wherein another end of the fifth side hole extends to the second side of the hammer head, wherein the insertion portion further includes a second coupling flange integrally formed therewith, wherein the second coupling flange is inserted into the fifth side hole, wherein the handle further includes a sixth side hole in a radial direction thereof, wherein an end of the sixth side hole intercommunicates with the hollow portion, wherein another end of the sixth side hole extends to the outer periphery of the insertion portion, wherein the sixth side hole is aligned with the fourth side hole, and wherein the inner periphery of the hollow portion includes a second squeezing groove aligned with the second coupling flange.

3. The hammer tool as claimed in claim 2, wherein the first coupling flange has a first spacing to an end face of the insertion portion in the longitudinal direction of the insertion portion, wherein the second coupling flange has a second spacing to the end face of the insertion portion in the longitudinal direction of the insertion portion, and wherein the second spacing is smaller than the first spacing.

4. The hammer tool as claimed in claim 1, wherein the handle further includes a limiting flange protruding radially outward from the outer periphery of the handle, wherein the limiting flange is contiguous to the insertion portion and has a third width in a diametric direction, wherein the third width is larger than the first diameter, and wherein the limiting flange extends around the outer periphery of the handle.

5. The hammer tool as claimed in claim 4, wherein the inner periphery of the hollow portion includes an annular groove extending around the inner periphery of the hollow portion, and wherein the annular groove is aligned with the limiting protrusion.

* * * * *